US005315931A

United States Patent [19]

Doersam

[11] Patent Number: 5,315,931

[45] Date of Patent: May 31, 1994

[54] BLANKET FIXING AND TENSIONING ASSEMBLY

[75] Inventor: Willi R. L. Doersam, Hoechberg, Fed. Rep. of Germany

[73] Assignee: Koenig & Bauer Aktiengesellschaft, Wurzburg, Fed. Rep. of Germany

[21] Appl. No.: 932,509

[22] Filed: Aug. 20, 1992

[30] Foreign Application Priority Data

Aug. 22, 1991 [DE] Fed. Rep. of Germany ..... 4127714

[51] Int. Cl.[5] ..... B41F 1/28

[52] U.S. Cl. ..... 101/415.1; 101/378

[58] Field of Search ..... 101/415.1, 378, 408–410, 101/383

[56] References Cited

U.S. PATENT DOCUMENTS

| | | | |
|---|---|---|---|
| 2,409,830 | 10/1946 | Braunworth | 101/378 |
| 2,859,693 | 11/1958 | Ziebell | 101/378 |
| 3,020,842 | 5/1960 | Neal | 101/415.1 |
| 3,125,023 | 3/1961 | Skinner et al. | 101/415.1 |
| 3,195,457 | 5/1963 | Luehrs | 101/378 |
| 4,183,299 | 1/1980 | Cappel | 101/415.1 |
| 4,367,679 | 1/1983 | Ishii et al. | 101/410 |

FOREIGN PATENT DOCUMENTS

| | | | |
|---|---|---|---|
| 2910880 | 3/1979 | Fed. Rep. of Germany . | |
| 2953815 | 3/1979 | Fed. Rep. of Germany . | |
| 3219741 | 5/1982 | Fed. Rep. of Germany . | |
| 7805125 | 2/1978 | France . | |
| 266520 | 2/1926 | United Kingdom . | |
| 0402103 | 11/1933 | United Kingdom | 101/378 |

*Primary Examiner*—Edgar S. Burr
*Assistant Examiner*—Anthony H. Nguyen
*Attorney, Agent, or Firm*—Jones, Tullar & Cooper

[57] ABSTRACT

A blanket fixing and tensioning assembly which is usable to secure and tighten a blanket on a blanket cylinder utilizes a blanket leading edge fixing and tensioning assembly together with a blanket trailing edge tensioning assembly. The leading edge can be fixed to the blanket and held in place while the blanket is applied to the blanket cylinder and its trailing edge secured and tensioned. The blanket can also be shifted circumferentially on the blanket cylinder to accommodate for blanket wear.

10 Claims, 4 Drawing Sheets

BLANKET FIXING AND TENSIONING ASSEMBLY

FIELD OF THE INVENTION

The present invention is directed generally to a blanket fixing and tensioning assembly. More particularly, the present invention is directed to an assembly for fixing and tensioning a blanket on a cylinder. Most specifically, the present invention is directed to an assembly for fixing and tensioning a blanket on a cylinder of a printing press. The assembly utilizes rotatable blanket end tensioning shafts which are placed generally parallel to each other in an axially extending recess on the surface of the blanket cylinder. The tensioning shaft for the blanket beginning end also carries spring biased tappet which is engaged by a cam lobe of a cam disk. This spring biased tappet is usable to initially fix the blanket leading end while the blanket is being wrapped around the periphery of the blanket cylinder. The blanket fixing and tensioning assembly facilitates installation of the blanket on the blanket cylinder.

DESCRIPTION OF THE PRIOR ART

Blanket cylinders in rotary printing press assemblies are provided with a resilient blanket surface. Since it would be impractical and difficult to apply a permanent resilient outer layer to a metal cylinder, a removable blanket is typically secured about the peripheral surface of the blanket cylinder so that it can be removed or repositioned. As may well be appreciated, a substantial amount of skill on the part of the printer or press operator is required to apply the blanket onto the blanket cylinder, to hold, and to tension the blanket on the cylinder. Typically, the blanket's leading edge can slide out of the blanket clamp as the blanket is wrapped around the cylinder's periphery before the tail or trailing edge of the blanket is placed into its clamps and tensioning is begun.

In German patent specification No. 29 53 815 there is shown a blanket tensioning device in which threaded bolts are placed in the cylinder groove. These bolts are connected over lever arms with the tensioning bars for the blanket. The tensioning of the blanket which can be accomplished using this prior art device is however quite limited, particularly with regard to the tensioning distance, since the pivoting angle of the lever arms is quite limited.

In German patent specification No. 32 19 741 there is shown another blanket tensioning device in which a locking element is provided in the blanket tensioning shaft. This locking element is automatically moved into a locking position by use of a closing cam. Each of the tensioning shafts in this prior art device is actuated by means of worm segments and a worm, as well as by use of a bevel gear through the use of tensioning screws. This assembly requires a large amount of actuating force because of the high frictional resistances caused by the worm. Additionally, the tensioning distance of the tensioning shafts is limited as the locking elements change in their radius. In this prior art device, it is not possible to accommodate a longer end of a blanket which is to be essentially stored at the trailing end tensioning assembly until such time as the leading end of the blanket may become worn and is to be taken up on the leading end tensioning assembly to prolong the useful life of the blanket.

The prior art devices for fixing and clamping a blanket to a blanket cylinder have had limited success due to their various drawbacks. Accordingly, there is an ongoing need for an apparatus which will overcome the limitations of the prior devices. The blanket fixing and tensioning assembly in accordance with the present invention overcomes the limitations of the prior art and is a significant improvement over the prior devices.

SUMMARY OF THE INVENTION

It is an object of the present invention to provide a blanket fixing and tensioning assembly.

Another object of the present invention is to provide an assembly for fixing and tensioning a blanket on a cylinder.

A further object of the present invention is to provide an assembly for fixing and tensioning a blanket on a cylinder of a printing press.

Still another object of the present invention is to provide a blanket fixing and tensioning assembly which allows the blanket to be held on the cylinder while it is being applied to the cylinder.

Yet a further object of the present invention is to provide a blanket fixing and tensioning assembly which can accommodate a long blanket end.

Even still another object of the present invention is to provide a blanket fixing and tensioning assembly which does not require a large expenditure of force.

As will be discussed in greater detail in the description of the preferred embodiment which is set forth subsequently, the blanket fixing and tensioning assembly in accordance with the present invention utilizes a pair of tensioning shafts which are located generally adjacent to each other in a recess on the peripheral surface of the blanket cylinder. Both tensioning shafts have axes which are parallel to the axis of rotation of the cylinder. Each of the tensioning shafts is rotatable by means of a tensioning screw and both tensioning shafts carry a generally hook-shaped clamping bar which will engage a leading or trailing end of a blanket. The leading end tensioning shaft also carries a hooked arm which is rotatable into engagement with a reinforcement plate on the leading end of the blanket. This hooked arm will rotate into engagement with the reinforcing plate on the blanket leading edge when a lobe of a cam is brought out of engagement with a spring biased tappet. As the tappet falls, it pivots the hook arm into a blanket fixing position which fixes the leading edge of the blanket to the cylinder while the blanket is being applied to the cylinder and its trailing edge blanket tensioning shaft. Once this has been accomplished, the leading edge tensioning shaft can be actuated to tension the blanket on the blanket cylinder.

A primary advantage of the blanket fixing and tensioning assembly of the present invention resides in the arrangement of a locking device which is actuated by the same elements as those used to tension the blanket. This allows the printer or press operator to initially fix the leading edge of the blanket to the cylinder, to then clamp the trailing edge of the blanket, and to then tension the blanket. The initial fixing of the leading edge of the blanket to the blanket cylinder allows the blanket to be fixed to the cylinder as it is being wrapped around the cylinder.

A toothed gear drive and a toothed bar are used in the present blanket fixing and tensioning assembly. This provides a smooth operation of the assembly during tensioning of the blanket. Only a small expenditure of force is required to actuate the tensioning shafts.

A further advantage of the present invention resides in the provision of a lengthy rotational distance of the tensioning shafts. These shafts can each be rotated through a large angle so that a substantial reserve portion of the blanket can be secured in the tensioning assembly. If the blanket is subjected to excessive wear or damage, particularly in the region of the leading edge of the blanket, it can be shifted on the blanket cylinder in such a way as to be moved into another position which will remove the worn leading edge portion from the surface of the blanket cylinder.

The blanket cylinder fixing and tensioning assembly of the present invention overcomes the limitations of the prior art devices and is a substantial advance in the art.

BRIEF DESCRIPTION OF THE DRAWING

While the novel features of the blanket fixing and tensioning assembly in accordance with the present invention are set forth with particularity in the appended claims, a full and complete understanding of the invention may be had by referring to the detailed description of the preferred embodiment which is presented subsequently, and as illustrated in the accompanying drawings in which:

DESCRIPTION OF THE PREFERRED EMBODIMENT

Figure 1:
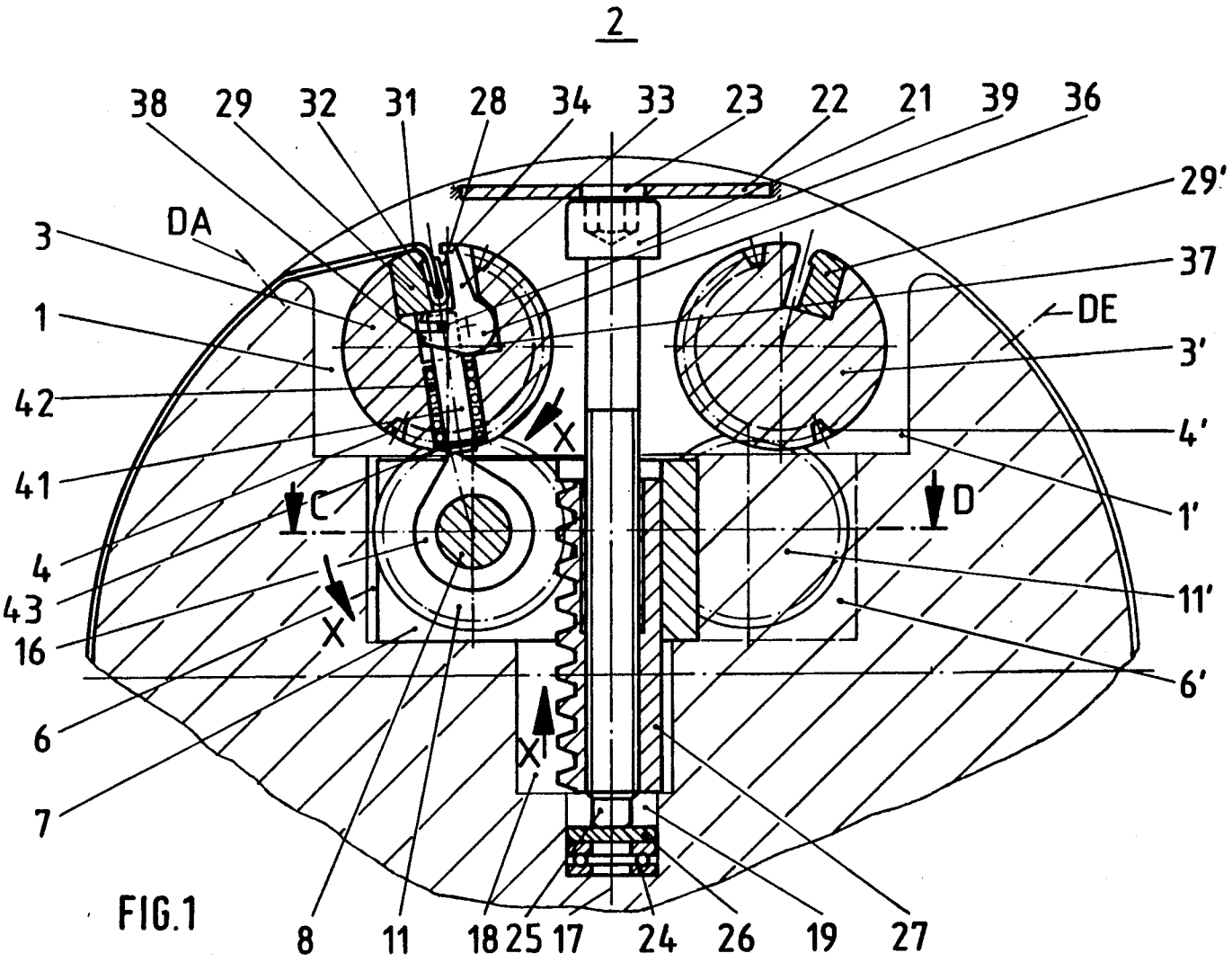
FIG. 1 is a cross-sectional view of a portion of a blanket cylinder taken along line A-B of FIG. 3 and showing the blanket fixing and tensioning assembly of the present invention with the assembly in a rest position and showing a leading end of a blanket inserted in the leading end tensioning shaft.

Referring initially to FIG. 1 which is a cross-sectional view through a portion of a blanket cylinder and depicting the blanket fixing and tensioning assembly of the present invention in a rest position, there is shown a blanket cylinder generally at 2. The blanket cylinder 2 has a cylinder groove 1 which is located adjacent the periphery of the blanket cylinder 2 and which carries a rotatable tensioning shaft 3. This tensioning shaft 3, which is used to secure a leading edge of a blanket and which will hence be indicated as the leading blanket edge tensioning shaft 3, is supported in cylinder groove 1 for rotation in a generally conventional manner. The blanket leading edge tensioning shaft 3 is arranged so that its axis of rotation is generally parallel to the axis of rotation of the blanket cylinder 2. The blanket tensioning shaft 3 has a plurality of gear teeth 4 around a portion of its circumference.

Figure 2:
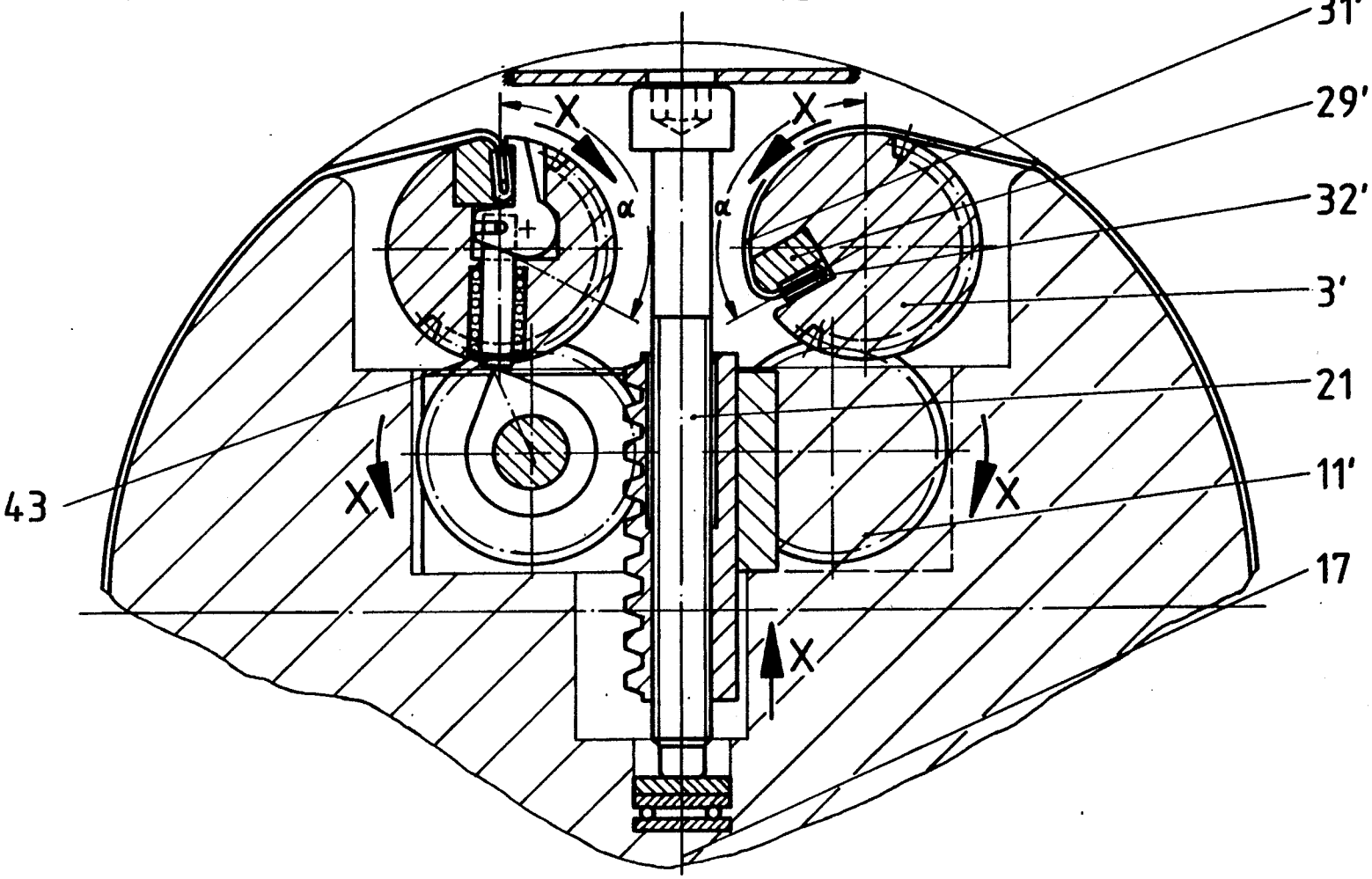
FIG. 2 is a cross-sectional view similar to FIG. 1 and showing the blanket leading edge fixed and with the trailing edge of the blanket inserted and tensioned by the trailing edge tensioning shaft.

As may be in FIGS. 1 and 2, the cylinder groove 1 has a recess 6 which receives a bearing bracket 7. A plurality of spaced screws 5 are used to secure the bearing bracket 7 in place in the recess 6. A shaft 8 is supported for rotation in the bearing bracket 7 and is aligned generally parallel to the tensioning shaft 3. An intermediate gear 11 .is secured to shaft 8 by use of a key 9 so that the intermediate gear 11 rotates with the shaft 8. Spaced retaining rings 12 and 13 hold the shaft 8 from sliding axially in the bearing bracket 7. A cam disk 16 is secured to one end of the shaft 8 by a suitable set screw 14 so that it rotates with shaft 8.

A borehole 18 extends radially into the blanket cylinder 2 in the middle of the recess 6 in the cylinder groove 1. This borehole 18 is centered on a radial centerline 17. A threaded supplementary bore 19 is formed at the radially inner end of the borehole 18. A tensioning screw 21 is positioned in the threaded bore 19. An outer end of the tensioning screw 21 is positioned near the circumference of the blanket cylinder 2 beneath a retaining plate 22. This retaining plate 22 has a central borehole 23 through which a head portion of the tensioning screw 21 can be accessed. The retaining plate 22 is held in the cylinder groove by a plurality of stud bolts which are not specifically depicted in the drawings. An inner end of the tensioning screw 21 rests on a thrust bearing 24 with a washer 24 over a journal 25. The tensioning screw 21 can thus be rotated but will not move radially inwardly or outwardly in its borehole 18 and supplementary borehole 19.

A toothed rod or sleeve 27 is carried by a threaded intermediate portion of the tensioning screw 21. Thus as the threaded screw 21 is turned, the threaded rod 27 will be caused to move radially inwardly or outwardly in the bearing bracket 7. As may be seen most clearly in FIG. 3, this toothed rod 27 engages the intermediate gear 11 on the shaft 8. As the tensioning screw 21 is rotated, the toothed rod 27 will move up or down to thereby rotate the intermediate gear 11 and the shaft 8 will be caused to rotate. Since the teeth of the intermediate gear 11 also mesh with the teeth 4 on the periphery of the tensioning shaft 3, rotation of the tensioning screw 21 will also cause the tensioning shaft 3 to rotate.

Referring again to FIG. 1, the tensioning shaft 3 has a radially inwardly extending recess 28 which extends axially along the length of the tensioning shaft 3. A hook-shaped clamping bar 29 is secured in one side wall of this recess 28. This clamping bar 29 will engage a reinforcement plate 32 which is attached to a leading edge 31 of the blanket to be attached to the blanket cylinder 2. A generally hook-shaped locking device is also carried in the tensioning shaft 3. This hook-shaped locking device has a radially outwardly extending arm 33 that has a hook 34 at its outer end. This hook 34 is generally rectangular in cross-section. At its radially inner end, the arm 33 is formed as a generally cylindrical bearing piece 36 which is rotatably secured in an enlarged inner recess 37 in the tensioning shaft 3. The bearing piece 36 also has two fork-shaped guide slots 38. Each of these two spaced guide slots 38 receives a free end of a generally rectangular pin 39. This pin 39 extends out along the longitudinal axis of the tensioning shaft 3 on both sides of a radially extending slidable tappet 41. As may be seen most clearly in FIG. 1, tappet 41 has a radially outer end which carries pin 39, and a radially inner end which rides on the cam disk 16 which, as was discussed previously, is attached to the rotatable shaft 8. A compression spring 42 is concentric with the tappet 41 and both the tappet 41 and the spring 42 are secured in a radial pocket bore in the tensioning shaft 3. The lower end of the tappet 41 adjacent the cam disk 16 is provided with a disk 43 against which the lower end of the spring 42 exerts a force. The upper end of the spring 42 engages a lip of the pocket borehole. A smaller diameter of the pocket borehole extends through the center of the tensioning shaft 3 and into the recess 37 so that the pin carrying end of the tappet 41 will be between the two fork-shaped guide slots 38 of the bearing piece 36 of the hook-shaped locking device.

It will be understood that the description of the blanket fixing and tensioning assembly in accordance with the present invention has to this point been directed to the blanket leading edge tensioning shaft 3 and its associated components. By referring to FIGS. 1 and 3, it will be seen that this portion of the assembly is located generally to the left of the centerline 17. The hook shaped clamping bar 29 is usable to engage the leading edge 31 of the blanket being positioned on the blanket cylinder 2. A generally similar assembly for use in tensioning a trailing edge portion 31' of the blanket is carried in the cylinder groove 1, generally to the right of the centerline 17. Each of the component parts located to the right of the centerline 17 is denoted with a ' after the reference number. Thus the tensioning shaft to the right of the blanket cylinder tensioning screw 21 is identified as tensioning shaft 3'. The same numbering system is carried through in the other figures of the drawings. The difference between the two assemblages of elements is that the right side device which is used for tensioning the trailing edge 31' of the blanket cylinder does not also need an arrangement to fix the blanket on the blanket cylinder 2 as the blanket is being wrapped around the cylinder 2. Thus the right or trailing edge side device does not include a cam disk, a tappet, a spring, a bearing piece and an arm and hook. The remaining elements are utilized in both the blanket leading and trailing edge assemblies.

In operation, the leading edge 31 of a blanket to be applied to the blanket cylinder 2 is positioned, as may be seen in FIG. 1 with its reinforcement plate 32 beneath the hook-shaped clamp bar 29 on the tensioning shaft 3 and in the recess 28. The tensioning screw 21 is then rotated by engagement of its head through aperture 23 in retaining plate 22 with a suitable tool. As the tensioning screw 21 is turned, the toothed rod 27 will move vertically and will rotate the intermediate gear 11 which will, in turn, rotate the shaft 8 to turn the cam disk 16. By moving the intermediate gear 11 in the direction indicated by arrow X in FIG. 1, the cam surface of the cam disk 11 moves out of engagement with the lower end of the tappet 41. This allows the spring 42 to force the tappet radially inwardly with respect to the blanket cylinder 2 so that the tappet pin 39 will pull the two fork shaped guides 38 in a radially inward direction. This results in a rotation of the arm 33 in a counterclockwise direction to bring the hook 34 into engagement with the reinforcement plate 32 on the leading edge 31 of the blanket. This position is depicted clearly in FIG. 2. In this position, the leading edge 31 of the blanket is fixed to the blanket cylinder 2.

Once the blanket leading edge 31 has been fixed to the blanket cylinder 2, the blanket can be wrapped around the blanket cylinder 2 so that a blanket trailing edge 31' can be secured to a trailing edge tensioning shaft 3' by insertion of the trailing edge 31' into the recess 28' for engagement with the trailing edge hook shaped clamp bar 29. This may also be seen in FIG. 2. As was discussed above, the trailing edge clamping assembly does not include the disk cam or the hook shaped locking device discussed in connection with the leading end fixing and tensioning assembly.

Figure 3:
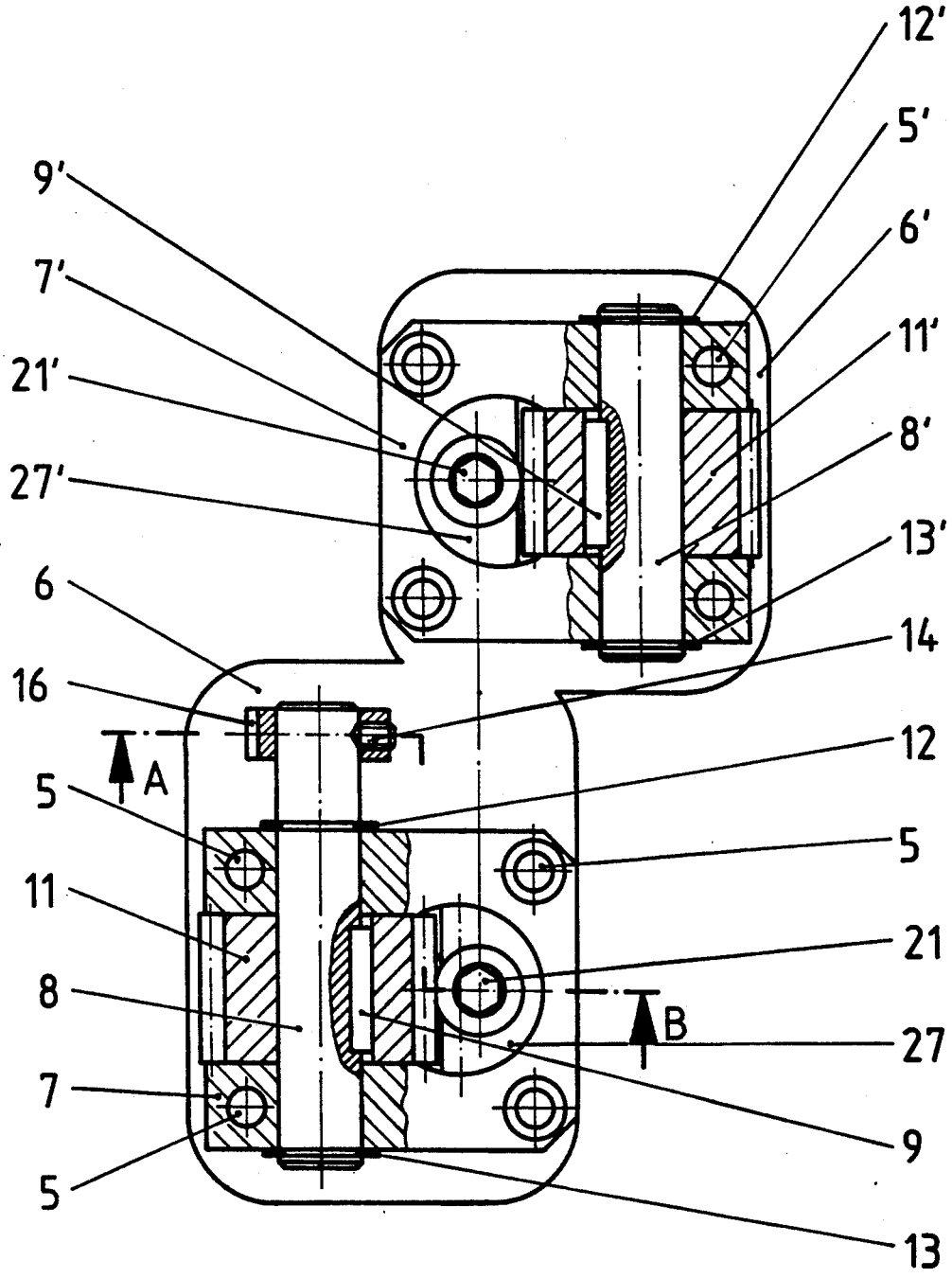
FIG. 3 is a top view of a portion of the assembly of the present invention taken along line C-D of FIG. 1.

Referring again to FIG. 2 and also referring to FIG. 3, the tensioning screw 21' is rotated in a manner similar to that discussed previously. This causes the toothed rod 27' to move vertically and to rotate the intermediate gear 11'. As intermediate gear 11' rotates in a clockwise direction, as indicated by the arrow X in FIG. 2, the tensioning shaft 3' moves in a counterclockwise direction, also as indicated by the arrow X. This rotation of the tensioning shaft 3' wraps the blanket trailing edge 31' on the tensioning shaft 3' and thus tensions the blanket on the blanket cylinder 2. If desired or necessary due to blanket length, the leading edge tensioning shaft 3 can also be rotated in the direction indicated by arrow X in FIG. 2 to further tension the blanket on the blanket cylinder 2.

Figure 4:
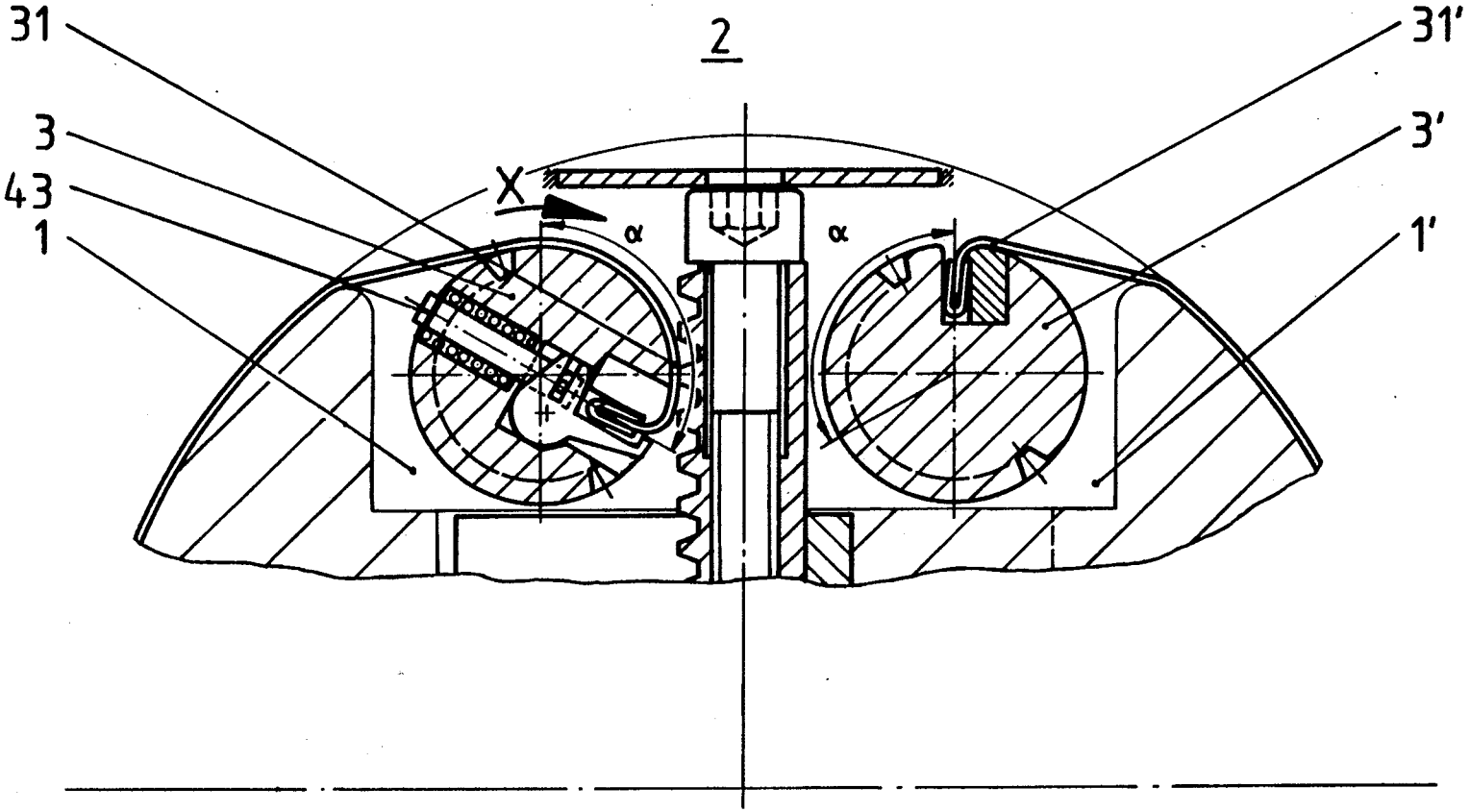
FIG. 4 is a cross-sectional view similar to FIGS. 1 and 2 and showing the blanket repositioned on the blanket cylinder and shifted to accommodate for wear on the leading portion of the blanket.

Comparing FIG. 2 with FIG. 4, it will be seen that the blanket fixing and tensioning assembly of the present invention can also be used to shift the blanket circumferentially around the blanket cylinder 2 to accommodate for wear on the blanket. In the depiction of FIG. 2, the trailing edge 31' of the blanket has been wrapped on the trailing edge tensioning shaft 3' through an angle $\alpha$. As the leading edge 31 of the blanket experiences wear, it is often desirable to shift the blanket. This can be easily accomplished by first rotating the trailing edge tensioning screw 21' to cause the trailing edge tensioning shaft 3' to rotate in a clockwise direction to loosen the blanket. Once the blanket has been loosened, the leading edge tensioning screw 21 can be rotated to turn the leading edge tensioning shaft 3 through a similar angle in the clockwise direction, as indicated by arrow X. The result, as seen in FIG. 4 is less blanket wrapped around the trailing edge tensioning shaft 3' and more blanket wrapped around the leading edge tensioning shaft 3. In the preferred embodiment of the present invention, the angle of rotation $\alpha$ depicted in FIGS. 2 and 4 for each of the tensioning shafts 3 and 3' is 135°.

While a preferred embodiment of a blanket fixing and tensioning device in accordance with the present invention has been set forth fully and completely hereinabove, it will be apparent to one of skill in the art that a number of changes in, for example the overall size of the blanket cylinder, the composition of the blanket, the supports for the tensioning shafts in the recesses in the blanket cylinder and the like can be made without departing from the true spirit and scope of the present invention which is accordingly to be limited only by the following claims.

What is claimed is:

1. A blanket fixing and tensioning assembly usable to secure and tension a blanket on a blanket cylinder, said blanket fixing and tensioning assembly comprising:

a blanket leading edge tensioning shaft rotatably positioned in a recess in a blanket cylinder;

means to attach a leading edge of a blanket to said blanket leading edge tensioning shaft;

means to lock said leading edge of a blanket to said leading edge tensioning shaft including a locking device having an arm, said arm having a blanket leading edge engaging hook at a first, outer end, a bearing piece at a second, inner end, and a generally fork-shaped guide slot intermediate said first and second ends;

a blanket trailing edge tensioning shaft rotatably positioned in said recess in said blanket cylinder; and means to attach a trailing edge of said blanket to said blanket trailing edge tensioning shaft.

2. The blanket fixing and tensioning assembly of claim 1 wherein said blanket leading edge tensioning shaft is rotatable by actuation of a blanket leading edge tensioning screw, said blanket leading edge tensioning screw being in engagement with a blanket leading edge intermediate gear, said blanket leading edge intermediate gear engaging a toothed peripheral portion of said leading edge tensioning shaft.

3. The blanket fixing and tensioning assembly of claim 2 wherein said blanket trailing edge tensioning shaft is rotatable by actuation of a blanket trailing edge tensioning screw, said blanket trailing edge tensioning screw being in engagement with a blanket trailing edge intermediate gear, said blanket trailing edge intermediate gear engaging a toothed peripheral portion of said trailing edge tensioning shaft.

4. The blanket fixing and tensioning assembly of claim 1 further including a tappet having a pin at a first, outer end, said pin being receivable in said fork-shaped guide slot.

5. The blanket fixing and tensioning assembly of claim 4 further including cam means to cause said tappet to move.

6. The blanket fixing and tensioning assembly of claim 5 wherein said cam means is rotatable with said blanket leading edge tensioning shaft through a rotatable shaft.

7. The blanket fixing and tensioning assembly of claim 2 wherein said blanket leading edge tensioning screw carries a leading edge toothed rod, said leading edge toothed rod engaging said blanket leading edge intermediate gear.

8. The blanket fixing and tensioning assembly of claim 3 wherein said blanket trailing edge tensioning screw carries a trailing edge toothed rod, said trailing edge toothed rod engaging said blanket trailing edge intermediate gear.

9. The blanket fixing and tensioning assembly of claim 7 wherein said cam means and said blanket leading edge intermediate gear are both secured to said rotatable shaft.

10. The blanket fixing and tensioning assembly of claim 9 wherein said rotatable shaft is supported by bearing brackets, said bearing brackets being positioned in a recess in a groove in said blanket cylinder.

* * * * *